US008814168B2

(12) United States Patent
Davis, Jr.

(10) Patent No.: US 8,814,168 B2
(45) **Date of Patent: *Aug. 26, 2014**

(54) SHOOTING TARGET, METHOD OF USE, AND METHOD OF MANUFACTURE

(71) Applicant: ZMB Industries, LLC, Poway, CA (US)

(72) Inventor: Roger George Lee Davis, Jr., Poway, CA (US)

(73) Assignee: ZMB Industries, LLC, Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/866,354

(22) Filed: Apr. 19, 2013

(65) Prior Publication Data

US 2013/0228974 A1 Sep. 5, 2013

Related U.S. Application Data

(63) Continuation-in-part of application No. 13/566,208, filed on Aug. 3, 2012.

(60) Provisional application No. 61/522,805, filed on Aug. 12, 2011.

(51) Int. Cl.

| | |
|---|---|
| ***F41J 5/14*** | (2006.01) |
| ***F41J 5/22*** | (2006.01) |
| ***F41J 5/24*** | (2006.01) |
| ***F41J 5/26*** | (2006.01) |

(52) U.S. Cl.

CPC .... *F41J 5/24* (2013.01); *F41J 5/22* (2013.01); *F41J 5/26* (2013.01)

USPC ..... 273/380

(58) Field of Classification Search

USPC ..... 273/378–380, 383–389; 62/457.3, 62/457.4

See application file for complete search history.

(56) References Cited

U.S. PATENT DOCUMENTS

| | | | | |
|---|---|---|---|---|
| 2,148,438 | A * | 2/1939 | Crain et al. | 273/384 |
| 3,330,561 | A * | 7/1967 | Kandel | 273/378 |
| 3,486,752 | A * | 12/1969 | Colvin et al. | 273/378 |
| 4,243,228 | A * | 1/1981 | Marcella | 273/378 |
| 4,781,595 | A * | 11/1988 | Cox | 434/81 |
| 4,921,256 | A * | 5/1990 | Gearhart | 273/378 |
| 5,197,743 | A * | 3/1993 | Hanson, Jr. | 273/378 |
| 5,653,124 | A * | 8/1997 | Weber | 62/457.4 |
| 6,966,557 | B2 * | 11/2005 | Kirk et al. | 273/349 |
| 8,596,643 | B1 * | 12/2013 | Edwards | 273/378 |
| 2011/0316234 | A1 * | 12/2011 | Miller, Sr. | 273/380 |

* cited by examiner

*Primary Examiner* — Mark Graham

(74) *Attorney, Agent, or Firm* — Stephen C. Beuerle; Procopio Cory Hargreaves & Savitch LLP

(57) ABSTRACT

A shooting target comprising a target body including an outer skin having a front face and an inner surface; an interior cavity; one or more fluid carriers disposed in the interior cavity, adjacent the outer skin, and carrying colored fluid; and a carrier backing urging the one or more fluid carriers against the inner surface of the outer skin. Upon penetration of the outer skin and the one or more fluid carriers, colored fluid is emitted from the one or more fluid carriers and onto the front face.

16 Claims, 3 Drawing Sheets

SHOOTING TARGET, METHOD OF USE, AND METHOD OF MANUFACTURE

BACKGROUND

1. Field of the Invention

This invention relates, in general, to shooting targets, and, in particular, to realistic training targets to help with improving marksmanship.

2. Related Art

Shooting targets developed in the past have generally been two-dimensional targets. A problem with two-dimensional shooting targets is that they do not sufficiently simulate a life-like, three-dimensional target situation. Another problem with shooting targets in the past is that when they are hit with projectiles, the shooting targets do not simulate the response of a life-like shooting target. These problems make it more difficult to improve markmanship when practicing with shooting targets. The more realistic the target is, the better training a shooter can have.

SUMMARY OF THE INVENTION

Accordingly, an aspect of the invention involves a life-like, reactive shooting target that simulates "bleeding" when hit with a projectile for a more realistic shooting experience to help with improving marksmanship.

Another aspect of the invention involves a shooting target comprising a target body having an outer skin having a front face; a backing; an interior cavity; one or more fluid carriers adjacent the outer skin and carrying colored fluid. Upon penetration of the outer skin and the one or more fluid carriers, colored fluid is emitted from the one or more fluid carriers and onto the front face.

One or more implementations of the aspect of the invention described immediately above includes one or more of the following: the front face of the shooting target is made of a plastic material; the front face of the shooting target is made of a material from the group consisting of PVC, PETG, Styrene, paper, and gelatin; the outer skin is in a configuration from the group consisting of a human form, a zombie form, a monster form, an animal profile, a round shape, a square shape, and a flat shape; the outer skin includes an inner surface and the one or more fluid carriers are in contact with the inner surface of the outer skin; the one or more fluid carriers are at least one of square, rectangular, round, and oval; the one or more fluid carriers include one or more colored paint carriers; the one or more colored paint carriers are a member from the group consisting of paint capsules, paint packets, and paint balls; the interior cavity includes a filler; the filler is foam that encases the one or more fluid carriers; the foam is two-part closed-cell spray-on foam in a 0.40-1.50 lb density; and/or the backing is a light-weight material member from the group consisting of paper, plastic, cardboard, and wood.

An additional aspect of the invention involves a method of using the above shooting targeting comprising receiving a projectile with the outer skin so that the projectile penetrates the outer skin and forms a hole in the outer skin; receiving a projectile with the one or more fluid carriers so that the projectile penetrates the one or more fluid carriers and forms a hole in the one or more fluid carriers corresponding to and adjacent the hole in the outer skin, causing colored fluid to flow out of the hole on the outer skin and flow along the outer skin; and receiving a projectile with the backing so that the projectile penetrates the backing, exits the shooting target through the backing and forms a hole in the backing.

In an implementation of the aspect of the invention described immediately above wherein the interior cavity includes a filler, the method further comprises receiving a projectile with the filler so that the projectile penetrates the filler and forms a hole in the filler.

A further aspect of the invention involves a method of manufacturing a shooting target comprising forming an outer skin made of at least one of a semi-rigid clear PVC, PETG, and plastic, the outer skin having an interior cavity and a front face; painting a life-like appearance on the front face; and adding one or more colored fluid carriers to the interior cavity adjacent to the outer skin; sealing the one or more colored fluid carriers in the interior cavity with a backing.

One or more implementations of the aspect of the invention described immediately above includes one or more of the following: back filling the interior cavity with a filler after adding the one or more colored fluid carriers and before sealing the one or more fluid carriers in the interior cavity; and/or the outer skin is at least one of thermoformed, injection molded, and a flat sheet cut to size.

A still further aspect of the invention involves a shooting target comprising a target body including an outer skin having a front face and an inner surface; an interior cavity; one or more fluid carriers disposed in the interior cavity, adjacent the outer skin, and carrying colored fluid; and a carrier backing urging the one or more fluid carriers against the inner surface of the outer skin. Upon penetration of the outer skin and the one or more fluid carriers, colored fluid is emitted from the one or more fluid carriers and onto the front face.

One or more implementations of the aspect of the invention described immediately above includes one or more of the following: the outer skin of the shooting target is made of a plastic material; the outer skin of the shooting target is made of a material from the group consisting of PVC, PETG, Styrene, paper, and gelatin; the outer skin is in a configuration from the group consisting of a human form, a zombie form, a monster form, an animal profile, a round shape, a square shape, a flat shape, a three-dimensional shape, and a two-dimensional shape; the carrier backing is a member of the group consisting of chopped paper, shredded paper, chopped cardboard, shredded cardboard, paper towel, tissue paper, and plastic wrap; the one or more fluid carriers are at least one of square, rectangular, round, and oval; the one or more fluid carriers include one or more colored paint carriers; the one or more colored paint carriers are a member from the group consisting of paint capsules, paint packets, and paint balls; the interior cavity includes a filler; the filler is foam that encases the one or more fluid carriers; the foam is two-part closed-cell spray-on foam in a 0.40-1.50 lb density; and/or the shooting target includes a body backing applied over the filler, and the body backing is a light-weight material member from the group consisting of paper, plastic, cardboard, and wood.

An additional aspect of the invention involves a method of using the above shooting targeting comprising urging the one or more fluid carriers against the inner surface of the outer skin with the carrier backing; receiving a projectile with the outer skin so that the projectile penetrates the outer skin and forms a hole in the outer skin; and receiving a projectile with the one or more fluid carriers urged against the inner surface of the outer skin so that the projectile penetrates the one or more fluid carriers and forms a hole in the one or more fluid carriers corresponding to and adjacent the hole in the outer skin, causing colored fluid to flow out of the hole on the outer skin and flow along the outer skin.

Another aspect of the invention involves a method of manufacturing a shooting target comprising forming an outer skin made of at least one of a semi-rigid clear PVC, PETG, and plastic, the outer skin having an interior cavity, a front face, and an inner surface; adding one or more colored fluid carriers to the interior cavity adjacent to the outer skin; and applying a carrier backing behind the one or more colored fluid carriers so that the carrier backing urges the one or more colored fluid carriers against the inner surface of the outer skin.

One or more implementations of the aspect of the invention described immediately above includes one or more of the following: the carrier backing is a member of the group consisting of chopped paper, shredded paper, chopped cardboard, shredded cardboard, paper towel, tissue paper, and plastic wrap; and/or back filling the interior cavity with a filler after adding the one or more colored fluid carriers and applying the carrier backing.

Other features and advantages of the present invention will become more readily apparent to those of ordinary skill in the art after reviewing the following detailed description and accompanying drawings.

BRIEF DESCRIPTION OF DRAWINGS

The details of the present invention, both as to its structure and operation, may be gleaned in part by study of the accompanying drawings, in which like reference numerals refer to like parts, and in which.

DETAILED DESCRIPTION OF THE INVENTION

Figure 1:
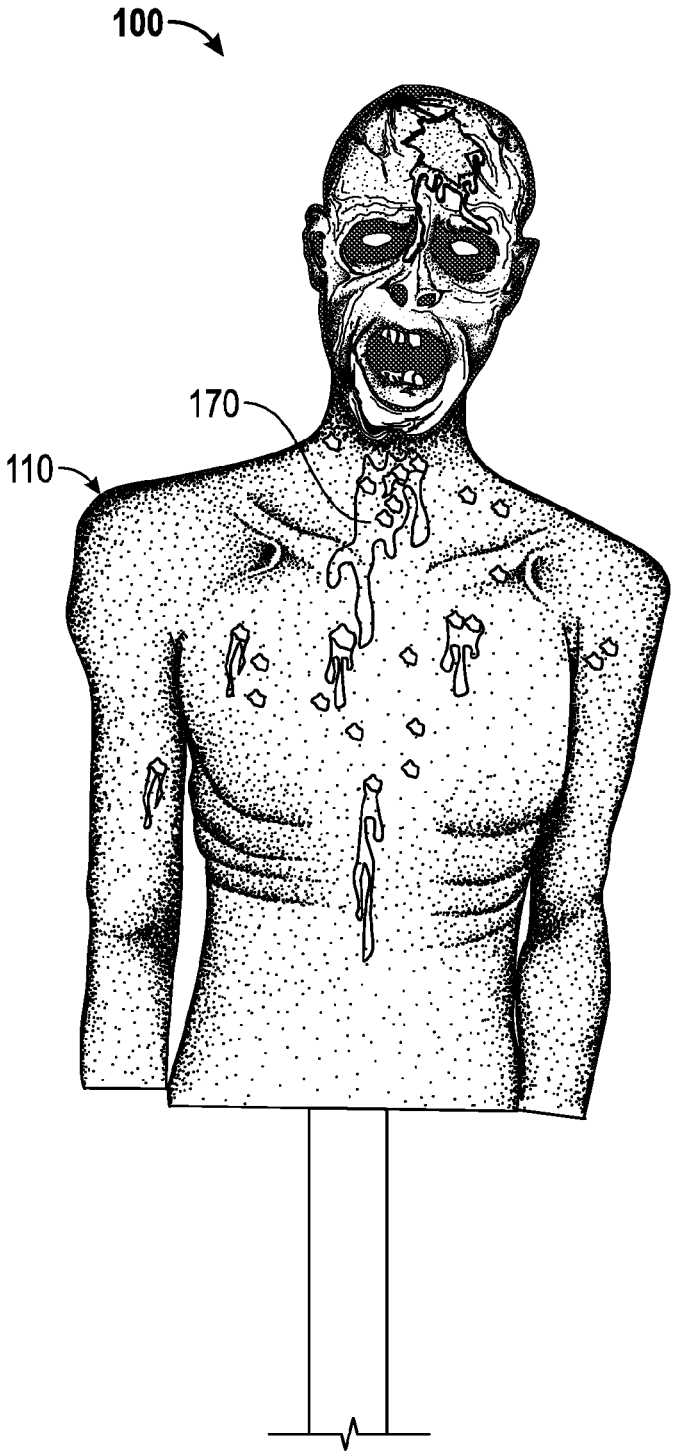
FIG. 1 is a perspective view of an embodiment of a life-like, reactive shooting target that simulates "bleeding" when hit with a projectile .
Figure 2:
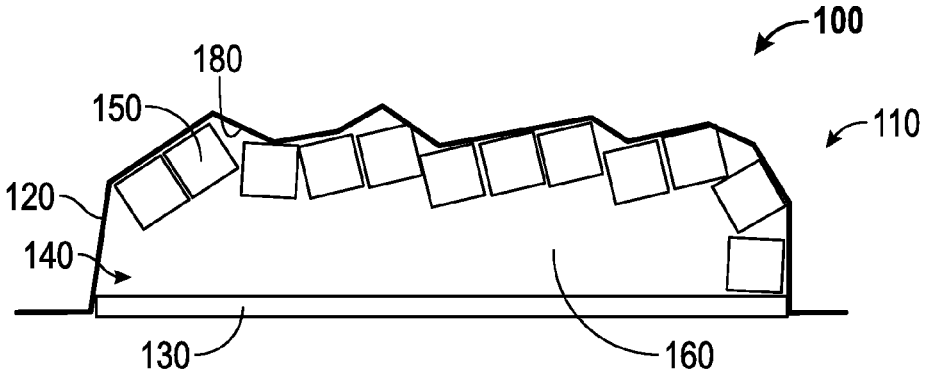
FIG. 2 is a simple cross-sectional view of an embodiment of shooting target.
Figure 3:
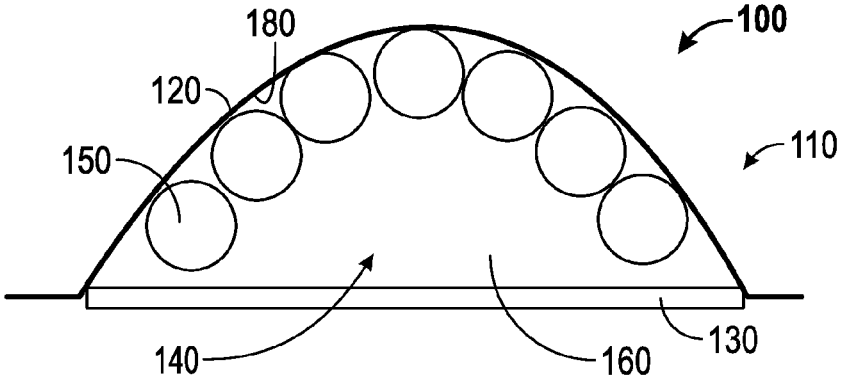
FIG. 3 is a simple cross-sectional view of another embodiment of shooting target.
Figure 4:
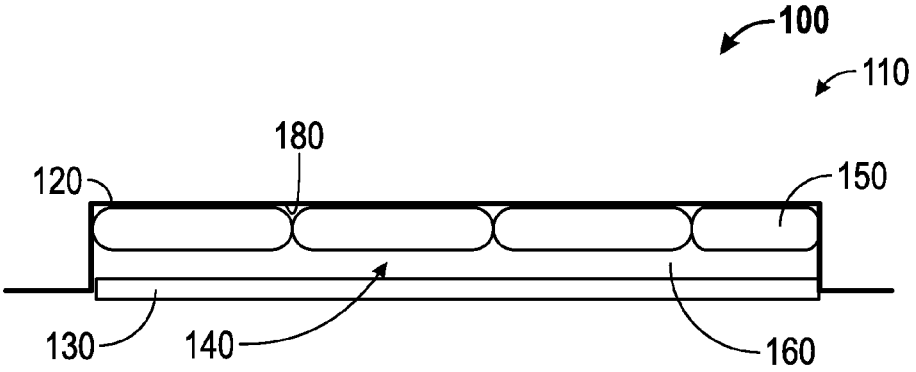
FIG. 4 is a simple cross-sectional view of a further embodiment of shooting target.

With reference to FIGS. 1-4, a shooting target 100 constructed in accordance with an embodiment of the present invention is a life-like, reactive shooting target that simulates "bleeding" when hit with a projectile for a more realistic shooting experience to help with improving marksmanship.

The shooting target 100 includes a shooting target mannequin body 110 with an outer skin/shell 120, a backing 130, an interior cavity 140, one or more fluid (e.g., paint) carriers 150, and filler 160.

The outer skin/shell 120 is on a front face 170 of the shooting target 100 and is a plastic material. In an exemplary, embodiment, the outer skin/shell 120 is made of 0.010-0.125" thick PVC, PETG, Styrene, paper, or gelatin product. In one or more embodiments, the outer skin/shell 120 is made in the shape of, but not limited to, a human form, an animal profile, a round shape, a square shape, and/or a flat shape/target. In one or more embodiments, the skin 120 is, but not limited to, thermoformed, injection molded, and/or is a flat sheet cut to size.

The one or more paint carriers 150 are placed in the interior cavity 140, along (and in contact with) an inner surface 180 of the outer skin/shell 120. In one or more embodiments, the one or more paint carriers 150 are a shape including, but not limited to, square, rectangular, round, and/or oval. In one or more embodiments of the paint carrier(s) 150, the paint carrier(s) 150 include colored paint in a plastic packet (e.g., akin to a ketchup packet). Because the one or more paint carriers 150 are disposed in the interior cavity 140, along (and in contact with) an inner surface 180 of the outer skin/shell 120, when the projectile penetrates the target 100 (projectile penetrates outer skin/shell 120 and paint carrier(s) 150), the colored paint, which may have the appearance of blood, will spin out onto the front of the skin 120. The one or more paint carriers 150 (e.g., paint capsules, paint packets) lie behind the outer skin 120 in a suitcase-type holding fixture to hold everything together.

In an exemplary embodiment, the filler 160 is two-part (A+B) spray-on foam that is applied behind the one or more paint carriers 150. Two-part closed-cell spray-in/on foam, in a 0.40-1.50 lb density, is applied behind the one or more paint carriers 150 (e.g., similar to packaging foam used in industrial applications). The foam encases the paint carriers 150 (e.g., paint capsules, paint packets) while adhering the skin 120 to everything. The foam provides two main functions: a) holds the paint carriers 150 firmly against outer skin/shell 120, pushing the paint out of the front of the target 100, and b) holds the backing 130 and skin 120 all together onto the target 100, acting as a glue.

The backing 130 is applied to a back/rear of the target 100 during foam expansion and curing. The backing 130 is made of a light-weight material, allowing the bullet to pass easily there through. The backing 130 is made from, but not by way of limitation, paper, plastic, cardboard, and or wood. The backing 130 holds the filler 160 (e.g., foam) securely to the front of the target 100 creating a seal for the back.

In use, when a projectile (e.g., shot by a firearm, BB gun, Airsoft gun, bow) penetrates the target 100, the outer skin 120 receives and is penetrated by the projectile to form a hole in the outer skin 120. An adjacent paint carrier 150 is penetrated by the projectile to form a hole in the carrier 150 corresponding to and adjacent the hole in the outer skin, causing paint to flow out of the holes on drip down the front face 170 of the target 100. The colored paint preferably has the appearance of blood oozing out of the holes and down the front face 170 of the target 100. The filler 160 is penetrated by the projectile to form a hole in the filler 160. Further, the backing 130 is penetrated by the projectile to form a hole in the backing 130 and exit a rear side of the target 100.

An exemplary method of manufacturing the bleeding mannequin tactical target 100 will now be described. A life size, life-like dimensional mannequin body 110 is made from an outer skin 120 including a semi-rigid 0.25-0.055" clear PVC, PETG or similar clear plastic; then painted on the inside or outside to look life-like. One or more paint carriers 150 in the form of a layer of small balls filled with paint (i.e., paint balls) are layered in the interior cavity 140, along (and in contact with) the inner surface 180 of the outer skin/shell 120. Then, the interior cavity 140 is back-filled with filler 160 in the form of 1 lb. biodegradable 2-part foam. The rear/back of the target 100 is sealed with backing 130. The bleeding mannequin tactical target 100 is then placed on the ground, a base, hung on a board, or otherwise uprighted.

Figure 5:
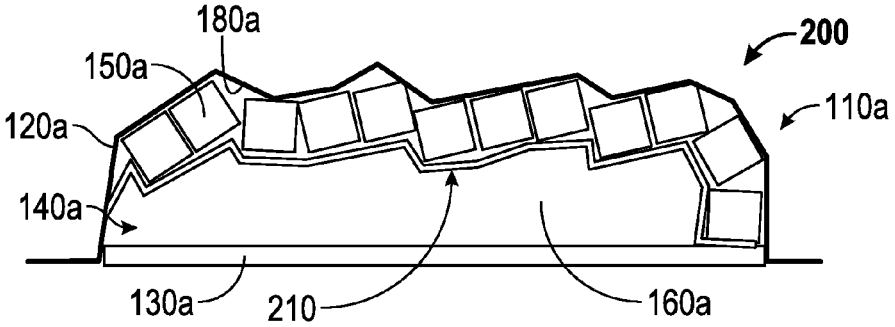
FIG. 5 is a simple cross-sectional view of another embodiment of a shooting target and shows an example configuration.
Figure 6:
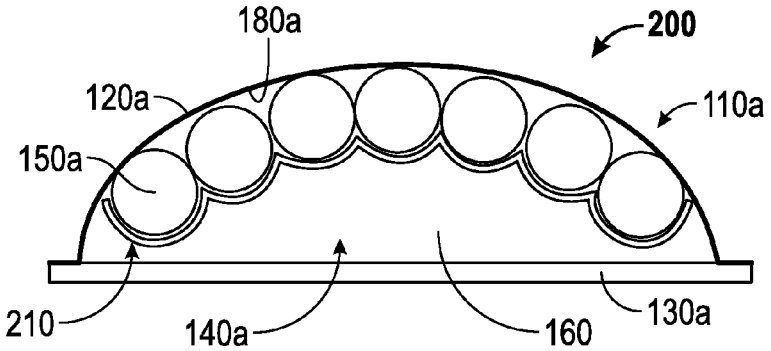
FIG. 6 is a simple cross-sectional view of another configuration of the shooting target of FIG. 5.
Figure 7:
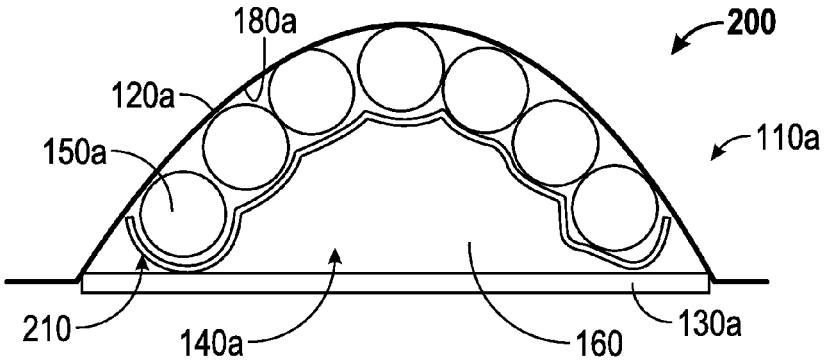
FIG. 7 is a simple cross-sectional view of a further configuration of the shooting target of FIG. 5.
Figure 8:
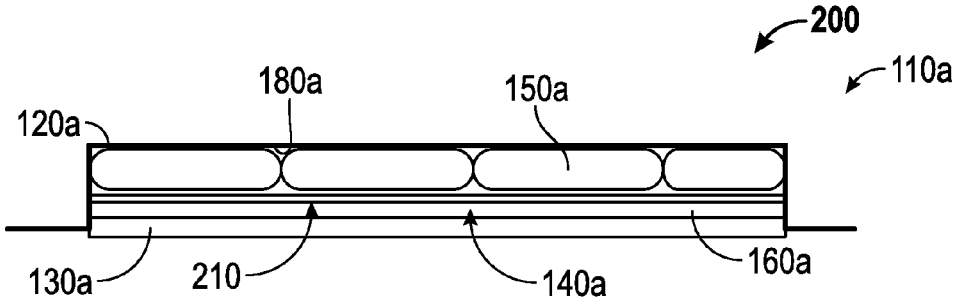
FIG. 8 is a simple cross-sectional view of a still further configuration of the shooting target of FIG. 5.

With reference to FIGS. 5-8, multiple example configurations of another embodiment of a "bleeding" shooting target 200 (and method of manufacturing and method of use) will be described. Because the shooting target 200 is similar to the shooting target 100 described above with respect to FIGS. 1-4, the description of like elements is incorporated herein, will generally not be described below, and will be identified with the same reference numbers, but with an "a" suffix.

The shooting target 200 includes a shooting target mannequin body 110*a* with an outer skin/shell 120*a*, a body backing 130*a*, an interior cavity 140*a*, one or more fluid (e.g., paint) carriers 150*a*, a carrier backing 210, and a filler 160*a*.

The outer skin/shell 120*a* is on a front face 170*a* of the shooting target 200 and is a plastic material. In an exemplary, embodiment, the outer skin/shell 120*a* is made of 0.010-0.125" thick PVC, PETG, Styrene, paper, or gelatin product. In one or more embodiments, the outer skin/shell 120*a* is made in the shape of, but not limited to, a human form, an animal form, a round shape, a square shape, and/or a flat (e.g., two-dimensional) shape/target. In one or more embodiments, the skin 120*a* is, but not limited to, thermoformed, injection molded, and/or is a flat sheet cut to size.

A carrier backing 210 is placed behind the one or more paint carriers 150*a* before a foam application process. The material of the carrier backing 210 is, for example, but not by way of limitation, chopped or shredded paper, chopped or shredded cardboard, paper towel, tissue paper or plastic wrap and is placed on top of the one or more paint carriers 150*a* (e.g., if the front face 170*a* of the outer skin/shell 120*a* is face down) prior to foam fill to assist in keeping or urging the one or more paint carriers 150*a* against the inner surface 180*a* of the skin 120*a*. This process also aids in the target oozing with lower velocity projectiles.

The filler 160*a* (e.g., two-part (A+B) spray-on foam) is applied behind the one or more paint carriers 150*a* as described above.

The backing 130*a* is applied to a back/rear of the target 200 during foam expansion and curing as described above.

In use, when a projectile (e.g., shot by a firearm, BB gun, Airsoft gun, bow) penetrates the target 200, the outer skin 120*a* receives and is penetrated by the projectile to form a hole in the outer skin 120*a*. An adjacent paint carrier 150*a* is penetrated by the projectile to form a hole in the carrier 150*a* corresponding to and adjacent the hole in the outer skin 120*a*, causing paint to flow out of the holes on drip down the front face 170*a* of the target 200. The carrier backing 210 applied to the back of the one or more paint carriers 150*a* holds and urges the one or more paint carriers 150*a* against the inner surface 180*a* of the skin 120*a* and helps oozing feature with lower velocity projectiles (e.g., from bb gun airsoft). The colored paint preferably has the appearance of blood oozing out of the holes and down the front face 170*a* of the target 200. The filler 160*a* may be penetrated by the projectile to form a hole in the filler 160*a*. Further, the backing 130*a* may be penetrated by the projectile to form a hole in the backing 130*a* and exit a rear side of the target 100*a*.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

While illustrative embodiments of the invention are disclosed herein, it will be appreciated that numerous modifications and other embodiments can be devised by those skilled in the art. Features of the embodiments described herein, can be combined, separated, interchanged, and/or rearranged to generate other embodiments. Therefore, it will be understood that the present application is intended to cover all such modifications and embodiments that come within the spirit and scope of the present invention.

I claim:

1. A shooting target, comprising:

a target body comprising:

an outer skin having a front face and an inner surface;

an interior cavity;

multiple independent fluid carriers disposed in the interior cavity, adjacent the outer skin, and carrying colored fluid;

a carrier backing urging the multiple independent fluid carriers against the inner surface of the outer skin, wherein upon penetration of the outer skin and the multiple independent fluid carriers, colored fluid is emitted from the multiple independent fluid carriers and onto the front face.

2. The shooting target of claim 1, wherein the outer skin of the shooting target is made of a plastic material.

3. The shooting target of claim 1, wherein the outer skin of the shooting target is made of a material from the group consisting of PVC and PETG.

4. The shooting target of claim 1, wherein the outer skin is in a configuration from the group consisting of a human form, a zombie form, a monster form, an animal profile, a round shape, a square shape, a flat shape, a three-dimensional shape, and a two-dimensional shape.

5. The shooting target of claim 1, wherein the carrier backing is a member of the group consisting of chopped paper, shredded paper, chopped cardboard, shredded cardboard, paper towel, tissue paper, and plastic wrap.

6. The shooting target of claim 1, wherein the multiple independent fluid carriers are at least one of square, rectangular, round, and oval.

7. The shooting target of claim 1, wherein the multiple independent fluid carriers include one or more colored paint carriers.

8. The shooting target of claim 7, wherein the multiple independent colored paint carriers are a member from the group consisting of paint capsules, paint packets, and paint balls.

9. The shooting target of claim 1, wherein the interior cavity includes a filler back filling the interior cavity between the multiple fluid carriers and the backing.

10. The shooting target of claim 9, wherein the filler is foam that encases the multiple non-connected fluid carriers.

11. The shooting target of claim 10, wherein the foam is two-part closed-cell spray-on foam in a 0.40-1.50 lb density.

12. The shooting target of claim 9, wherein the backing is cardboard.

13. A method of using the shooting target of claim 1, comprising:

urging the multiple independent fluid carriers against the inner surface of the outer skin with the carrier backing;

receiving a projectile with the outer skin so that the projectile penetrates the outer skin and forms a hole in the outer skin;

receiving a projectile with the multiple independent fluid carriers urged against the inner surface of the outer skin so that the projectile penetrates the multiple independent fluid carriers and forms a hole in the multiple independent fluid carriers corresponding to and adjacent the hole in the outer skin, causing colored fluid to flow out of the hole on the outer skin and flow along the outer skin.

14. A method of manufacturing a shooting target, comprising:

forming an outer skin made of at least one of a semi-rigid clear PVC, PETG, and plastic, the outer skin having an interior cavity, a front face, and an inner surface;

adding multiple non-connected colored fluid carriers to the interior cavity adjacent to the outer skin, the multiple non-connected fluid carriers independently movable relative to each other when added to the cavity;

applying a carrier backing behind the multiple non-connected colored fluid carriers so that the carrier backing urges the multiple non-connected colored fluid carriers against the inner surface of the outer skin.

15. The shooting target of claim 14, wherein the carrier backing is a member of the group consisting of chopped paper, shredded paper, chopped cardboard, shredded cardboard, paper towel, tissue paper, and plastic wrap.

16. A method of manufacturing a shooting target, comprising:

forming an outer skin made of at least one of a semi-rigid clear PVC, PETG, and plastic, the outer skin having an interior cavity, a front face, and an inner surface;

adding one or more colored fluid carriers to the interior cavity adjacent to the outer skin;

applying a carrier backing behind the one or more colored fluid carriers so that the carrier backing urges the one or more colored fluid carriers against the inner surface of the outer skin, and further comprising back filling the interior cavity with a filler after adding the one or more colored fluid carriers and applying the carrier backing.

* * * * *